United States Patent [19]

Kuna

[11] 4,159,117

[45] Jun. 26, 1979

[54] GAME APPARATUS

[75] Inventor: Wayne A. Kuna, Elmhurst, Ill.

[73] Assignee: Marvin Glass & Associates, Chicago, Ill.

[21] Appl. No.: 856,350

[22] Filed: Dec. 1, 1977

[51] Int. Cl.[2] ..... A63F 3/00

[52] U.S. Cl. ..... 273/243; 273/288

[58] Field of Search ..... 273/243, 248, 288, 290, 273/291, 289; 46/11, 153

[56] References Cited

U.S. PATENT DOCUMENTS

| | | | |
|---|---|---|---|
| 784,888 | 3/1905 | Reisner | 46/153 |
| 2,571,744 | 10/1951 | Midouhas | 46/11 |
| 3,235,263 | 2/1966 | Smith | 46/11 |
| 3,424,455 | 1/1969 | Dunson | 273/153 R |
| 3,656,751 | 4/1972 | Glass et al. | 273/243 |
| 4,040,628 | 8/1977 | Pope | 273/243 |

FOREIGN PATENT DOCUMENTS

| | | | |
|---|---|---|---|
| 645661 | 10/1950 | United Kingdom | 273/249 |

*Primary Examiner*—Richard C. Pinkham
*Assistant Examiner*—Scott L. Brown
*Attorney, Agent, or Firm*—Mason, Kolehmainen, Rathburn & Wyss

[57] ABSTRACT

A board game is designed around the theme of gaining and losing weight and counting calories and includes a game board having a playing surface defining a travel path with a plurality of separate stations along the path. Manually movable, hollow playing pieces styled as obese persons are provided for movement around the stations on the travel path. Each playing piece has associated therewith a set of stations on the game board representing restaurants and a plurality of weight elements are provided to be inserted into the open mouth of the hollow, playing pieces. Chance dice are provided for determining the number of stations along the path that each playing piece is moved during a turn and for determining a number of weight elements that are to be inserted into the open mouth of a playing piece. On the travel path, another player may be challenged to a weigh in and the playing piece having the heaviest weight then must discharge the weight elements and register the number in a cumulative score. The player ending up with the least number of calories or weight elements is the winner.

12 Claims, 6 Drawing Figures

GAME APPARATUS

BACKGROUND OF THE INVENTION

1. Field of the Invention

The present invention relates to board games and more particularly to a board game designed around the theme of eating different types of food having different calorie values for weight gain or loss.

2. Brief Description of the Prior Art

Many board games have enjoyed popularity throughout the years and such games have been designed around a wide variety of themes such as travel, economic activity, wealth accumulation, athletic contests, war games and the like. However, as far as is known, no board games have been developed around the theme of eating different foods having different calorific values with an object of the game being to gain the least amount of weight as represented by the number of accumulated calories.

SUMMARY OF THE PRESENT INVENTION

The foregoing and other objects and advantages of the present invention are accomplished in a new and unique board game including a game board having a playing surface defining a travel path for a plurality of hollow playing pieces. The travel path is formed with a plurality of separate stations and sets of some of the stations are identified to correspond with a particular color playing piece. The hollow playing pieces are fashioned in the form of a fat or obese person with an open mouth. A plurality of weight elements in the form of a letter "C" representing calories are provided for insertion into the open mouth of the playing pieces as the game is played. Chance means such as a pair of die are used for determining the number of weight elements or calories "C" which are to be inserted into the mouth of an opponent's playing piece when it comes to rest on a station in a player's set and the die may be used to determine the number of stations traversed during a player's move or turn. In addition, the game board is provided with one or more play stations which permit a player to make a choice between going to a steam bath wherein the chance device is utilized for determining the number of calories lost and for challenging another player to have their respective playing pieces weighed on a scale balance, wherein the player with the heavier playing piece is required to empty out the weight elements or calories "C" therein and keep a cumulative score of the total removed. Second chance means such as a deck of cards is used for providing random gains or losses of calories for the player whose pieces land on certain stations. The object of the game is to finish with the least number of calories "C" accumulated.

BRIEF DESCRIPTION OF THE DRAWINGS

For a better understanding of the invention, reference should be had to the following detailed description taken in conjunction with the drawings, in which.

DESCRIPTION OF THE PREFERRED EMBODIMENT

Figure 1:
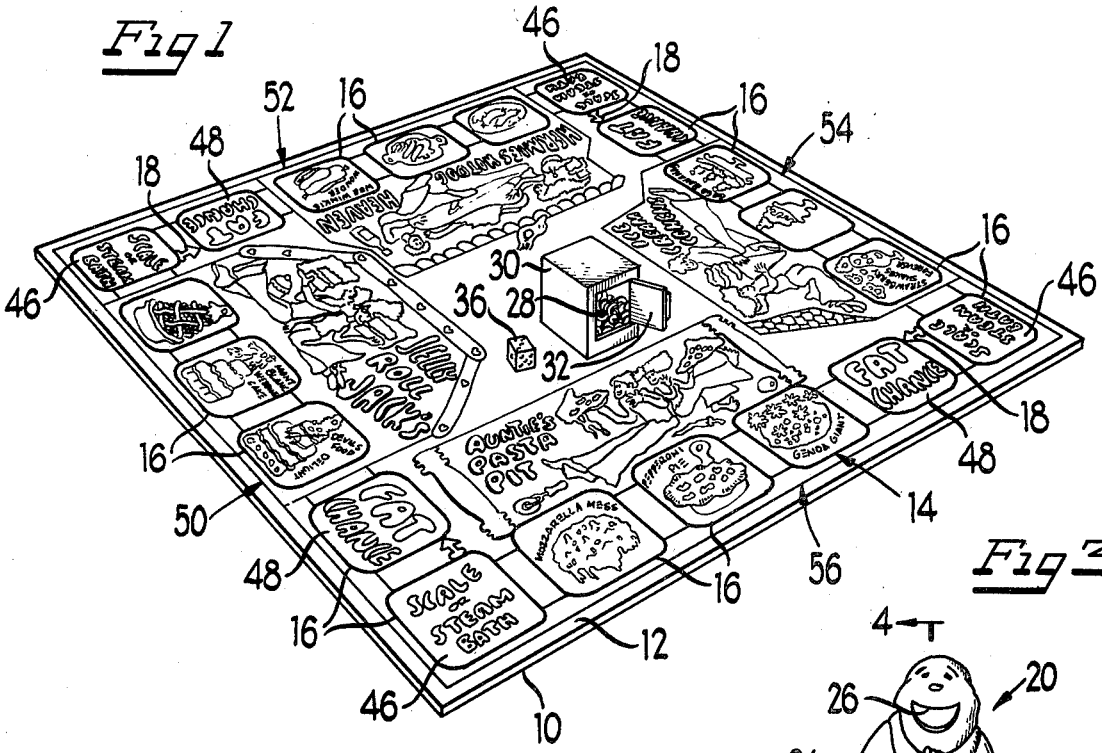
FIG. 1 is a perspective view illustrating the game board constructed in accordance with the features of the present invention and shown in a position ready for play.
Figure 3:
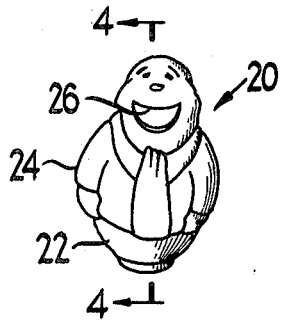
FIG. 3 is a front view of a hollow "fat person" playing piece in accordance with the invention.

Referring more particularly to the drawings, in FIG. 1 is illustrated a game board 10 in accordance with the present invention including a generally square upper playing surface 12. The game board is shown laid out in a flat condition ready for play and the playing surface is decorated to provide a travel path 14 around the perimeter formed of a plurality of spaced apart playing spaces or stations 16. Travel around the path is directed by a plurality of arrows 18 for a set of playing pieces 20 as shown in FIGS. 3 and 4.

Figure 4:
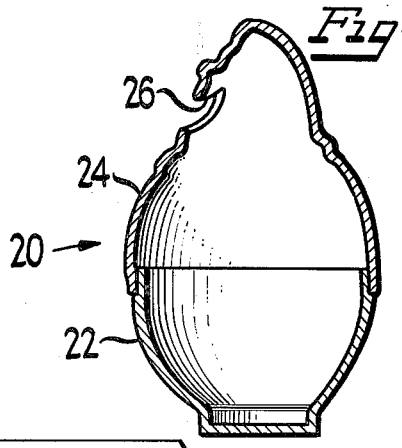
FIG. 4 is an enlarged vertical sectional view taken substantially along lines 4—4 of FIG. 3.
Figure 5:
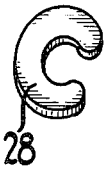
FIG. 5 is an enlarged perspective view of a calorie "C" or weight element used in the game.

The playing pieces are fashioned in the style of a generally fat, obese or rotund person and have large hollow interiors as illustrated in FIG. 4. Each playing piece has a lower half or base portion 22 and a removable upper half or top portion 24 and the portions are separable from one another when desired during play. Each playing piece is decorated in a manner distinguishing it from the other playing pieces and the head portion of the upper section of the playing pieces is formed with an enlarged opening or open mouth 26 for receiving weight elements 28 which are formed in the shape of the letter "C" (FIG. 5) representing calories, and hereinafter referred to as such.

During play of the game, the calories 28 are "eaten" by inserting them into the open mouths of the respective playing pieces 20 in accordance with the rules of the game and a supply of calories is initially contained in a refrigerator shaped enclosure 30 having a hinged door 32. The refrigerator is positioned adjacent the center of the playing surface 12 during the game.

Figure 2:
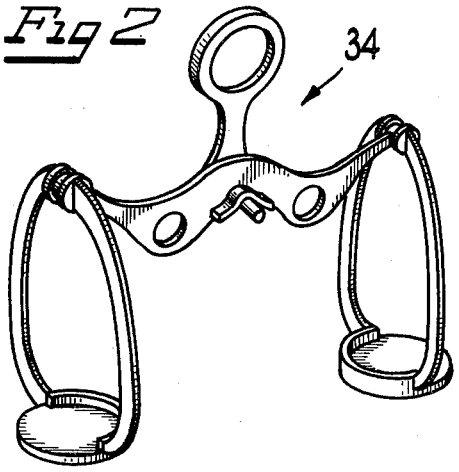
FIG. 2 is a perspective view of a scale balance device in accordance with the features of the present invention.

In FIG. 2 is illustrated a scale balance 34 used for making comparative weights of respective playing pieces 20 and any calories which may be contained therein. Movement around the travel path 14 for each of the respective playing pieces 20 is determined on a random or chance basis by a chance device such as a single die 36 and another element of chance in the game is provided by a deck of cards 38 having typical playing faces 40, 42 and 44 which require or direct a player to perform a specific activity.

Figure 6:
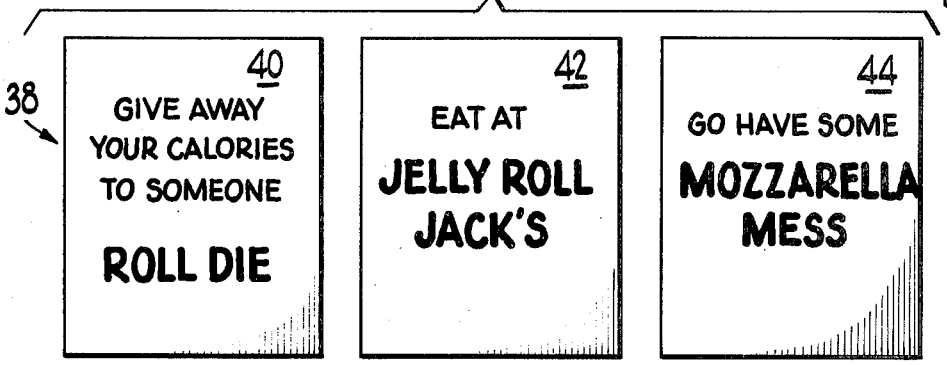
FIG. 6 is a view showing the faces of typical cards of a deck used as a chance device when playing the game.

At each corner of the game board 10 there is provided a playing station labeled "scale or steam bath" and when a playing piece 20 lands on one of these stations the player may choose between going to the "steam bath" and losing a number of calories "C" as determined by a roll of the die 36 or in the alternative, the player may challenge another player to "go to scale" on the scale balance 34. When a challenge is made, the two playing pieces of the respective players (with any accumulated calories 28 contained therein) are placed on the opposite pans of the scale balance and the heavier causes one side of the scale to dip. The scale balance is held by a finger projected through the center loop of the balance. The player having the heavier playing piece 20 is required to empty out all of the calories 28 on his side of the game board and these calories are counted up at the end of the game with the accumulative totals determining the winning order in that the player having the least number of calories 28 is the winner. Next to each "scale or steam bath" station, there is provided a playing space labeled "Fat Chance" and when a player lands on one of these stations, he draws a card from the deck 38 and proceeds in accordance with the instructions on the playing face of the card. Typical instructions are illustrated in FIG. 6.

Each playing piece 20 is identified by color or other indicia to correspond with a set of three playing stations in a row, with a row being located on each of the four sides of the game board. These four sets of three stations each are indicated by the reference numerals 50, 52, 54 and 56 and each station is provided with indicia representing a specialty food.

The set 50 is identified by a particular color background and the name of a restaurant or eating place entitled "Jelly Roll Jack's". The three playing stations in the corresponding set have indicia thereon representing different food specialties of the establishment such as "Devil's Food Delight", "Mont Blank Wedding Cake" and a dish such as strawberry shortcake. The set of playing spaces 52 is identified with an establishment or eating place known as "Hermie's Hotdog Heaven" and includes three playing spaces having different types of hotdogs or frankfurter specialties such as a "Wee Winkie Wonder", beans and franks, and bratwurst or knockwurst or the like. The next set of playing spaces 54 represents an establishment known as "Ice Cream Cohen's" and includes three playing stations indicating "Go Go Bananas", an ice cream sundae and a "Strawberry Snack Forever". Finally, the set of playing spaces 56 is identified with a restaurant or establishment known as "Auntie's Pasta Pit" and includes a playing station "Mozzarella Mess", another indicated as "Pepperoni Pie" and a third station indicated as "Genoa Giant". Each playing piece is also identified with a particular set of stations by means such as a common color background.

The faces of the respective cards in the "Fat Chance" deck 38 are provided with a variety of different instructions requiring a player to move his playing piece to particular playing stations of a particular restaurant or establishment and when a player arrives at a station which is not his own, he must then "eat" the number of calories on the station by placing the calories 28 inside the mouth of his playing piece.

To begin play of the game, each player chooses an empty playing piece 20 and then sits opposite the side of the game board 10 having the same background color as the playing piece chosen. Each player rolls the die 36 to determine how many calories 28 will be placed on each of the playing spaces for his set representing a particular food or dish. The players then start to roll the die and more their playing piece around the travel path 12 in successive turns. Each player starts from the playing station in his set that is closest to the corner of the game board and the number of playing spaces covered on each turn is determined by the players' roll of the die.

When a player lands on another player's specialty food, he must then eat up all the calories that are on that playing station by inserting the calories 28 into the mouth of his own playing piece. When he lands on a playing station of his own specialty food he may restock that playing station by rolling the die 36 and increasing the number of calories 28 resting thereon by taking new calories from the refrigerator.

When a player lands on one of the corner playing stations 46 he than has an option to either challenge another player that he thinks is heavier to "go to scale" for a comparative weight on the scale balance 34 or in the alternative, he may remove a number of calories in his playing piece by rolling the die to determine the number. The calories 28 are removed by disassembling the upper and lower halves of the playing pieces, taking out the desired number of calories and reassembling the halves.

When a player challenges another player to "go to scale", the heavier playing piece causes one side or pan of the scale balance to dip downwardly. The player having the heavier playing piece must then open up the playing piece and permanently remove all the calories 28 therein. The calories so removed are then out of the game and are stored on the particular player's side of the game board for cumulative counting at the end of the game. Whenever a player lands on one of the "Fat Chance" playing stations 48 he is required to draw a card from the deck 38 and then is directed to follow the instructions on the face of the card. Whenever a player lands on the same playing station that is already occupied by another playing piece, the player may then challenge the other player to "to go to scale".

After all of the calories 28 have been removed from the refrigerator 30 and the players then land on playing stations in their own set, they may restock their stations with calories taken from the playing stations of other players. When there are not more calories 28 left on the game board 10 or when one set of playing stations has all of the calories, the game is over and the winner is determined by the player who has the least number of accumulated calories on his side of the game board. The calories that are contained in the playing pieces 20 do not figure in the totalization used to determine the winner of the game.

From the foregoing it will be seen that the game is fun to play, and is developed around an interesting theme relating to restaurants or eating places featuring specialty foods, calorie counting and weight loss or gain.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A board game comprising:

a game board having a playing surface thereon defining a travel path with a plurality of separate stations thereon;

a manually movable hollow playing piece for each player adapted to be moved around said travel path of said playing surface to come to rest on said stations;

a plurality of weight elements dimensioned to be insertable into and removable from said hollow playing pieces for increasing the weight thereof;

scale means for comparing the relative weight of a pair of playing pieces including any weight elements therein; and chance means for determining the number of weight elements inserted into and/or removable from a playing piece coming to rest on a particular one of said stations.

2. The board game of claim 1 wherein said hollow playing pieces are formed with a mouth opening for receiving said weight elements which represent food calories.

3. The board game of claim 2 wherein said playing pieces are shaped to represent a fat person with a mid section larger than upper and lower end portions.

4. The board game of claim 3 wherein the stations in each set on said game board include indicia representing different foods to be eaten at a particular restaurant corresponding to the set depicted on said game board.

5. The board game of claim 2 wherein each of said playing pieces is formed with an upper portion detachably mounted on a lower base.

6. The board game of claim 5 wherein said upper portions of said playing pieces are secured to said lower base around said mid section.

7. The board game of claim 1 wherein a set of stations on said travel path are provided with indicia thereon corresponding to each of said playing pieces, whereby a playing piece on one player coming to rest on a station in a set corresponding to the playing piece of another player is required to have inserted a number of weight elements determined by said chance means.

8. The board game of claim 1 including secondary chance means for directing random particular actions when playing pieces land on a particular station on said game board.

9. The board game of claim 1 wherein said chance means includes indicia for directing movement of said playing pieces over a random number of successive stations on said travel path.

10. The board game of claim 1 wherein said game board includes at least one station on said travel path with indicia for permitting a player to challenge another player to compare the weight of their respective playing pieces on said scale means, the player having the heavier playing piece being required to have a number of weight elements in his playing piece counted against him in scoring the game.

11. The board game of claim 1 wherein said game board includes at least one station on said travel path with indicia for permitting the removal of a number of weight elements from a playing piece, when the playing piece lands on said one station.

12. The board game of claim 11 wherein said one station permits use of said indicia on said chance means to determine the number of weight elements removed from said playing piece.

* * * * *